United States Patent [19]

Garrard et al.

[11] Patent Number: 4,832,059

[45] Date of Patent: May 23, 1989

[54] CITRUS-FLAVORED TOBACCO ARTICLES

[75] Inventors: Victor G. Garrard, Durham; Albert B. Hudson, Greensboro, both of N.C.

[73] Assignee: Lorillard, Inc., Greensboro, N.C.

[21] Appl. No.: 130,072

[22] Filed: Dec. 8, 1987

[51] Int. Cl.[4] ..... A24B 3/12; A24B 15/30

[52] U.S. Cl. ..... 131/276; 131/275

[58] Field of Search ..... 131/276, 275

[56] References Cited

U.S. PATENT DOCUMENTS

| | | |
|---|---|---|
| 3,126,012 | 3/1964 | Jarboe et al. . |
| 3,332,427 | 7/1967 | Garzia . |
| 3,407,821 | 10/1968 | Sokoloff . |
| 3,550,598 | 12/1970 | McGlumphy . |
| 3,652,593 | 3/1972 | Gautschi et al. . |
| 3,753,738 | 8/1973 | Gautschi et al. . |
| 3,805,804 | 4/1974 | Quinn . |
| 3,861,403 | 1/1975 | Vinals et al. . |
| 3,879,425 | 4/1975 | Hall et al. . |
| 3,890,981 | 6/1975 | Vinals et al. . |
| 3,922,237 | 12/1975 | Schreiber et al. . |
| 3,928,456 | 12/1975 | Kovats et al. . |
| 3,928,645 | 12/1975 | Mookherjee et al. . |
| 3,940,499 | 2/1976 | Pittet et al. . |
| 3,959,508 | 5/1976 | Pittet et al. . |
| 3,977,418 | 8/1976 | Vinals et al. . |
| 3,987,803 | 10/1976 | Hall et al. . |
| 3,988,487 | 10/1976 | Sanderson . |
| 4,000,090 | 12/1976 | Pittet et al. . |
| 4,014,351 | 3/1977 | Pittet et al. . |
| 4,062,894 | 12/1977 | Sprecker et al. . |
| 4,081,479 | 3/1978 | Hall et al. . |
| 4,081,481 | 3/1978 | Sprecker et al. . |
| 4,128,101 | 12/1978 | Kulka et al. . |
| 4,129,134 | 12/1978 | Hind et al. . |
| 4,159,347 | 6/1979 | Yoshida et al. . |
| 4,175,569 | 12/1979 | Hall et al. . |
| 4,179,448 | 12/1979 | Schulte-Elte et al. . |
| 4,187,863 | 2/1980 | Kovats et al. . |
| 4,250,338 | 2/1981 | Sprecker et al. . |
| 4,320,771 | 3/1982 | Sprecker et al. . |
| 4,405,646 | 9/1983 | Boden et al. . |
| 4,485,828 | 12/1984 | Klemarczyk et al. . |
| 4,570,648 | 2/1986 | Schenk . |
| 4,627,449 | 12/1986 | Kiwala et al. . |
| 4,669,490 | 6/1987 | Naegli et al. . |

FOREIGN PATENT DOCUMENTS

| | | |
|---|---|---|
| 52-061296 | 5/1977 | Japan . |
| 52-140482 | 11/1977 | Japan . |
| 52-134098 | 11/1977 | Japan . |
| 7410141 | 2/1975 | Netherlands . |

OTHER PUBLICATIONS

*Tobacco Flavoring for Smoking Products* by Leffiugwell et al., published by RJR-Tobacco (1972), Winston-Salem, N.C., pp. 19 & 63 cited.

Publications Bedoukian, *Perfuming and Flavoring Synthetics*, 3d Ed., pp. 106-118.

*Primary Examiner*—V. Millin

*Attorney, Agent, or Firm*—Brumbaugh, Graves, Donohue & Raymond

[57] ABSTRACT

Tobacco articles, including cigarettes, cigars, pipe tobacco and chewing tobacco, and the like, containing citral acetal which have a fresh, clean, true and long-lived citrus aroma and flavor.

15 Claims, No Drawings

CITRUS-FLAVORED TOBACCO ARTICLES

BACKGROUND OF THE INVENTION

This invention relates to novel citrus-flavored tobacco articles, and processes for producing same. More particularly, it relates to tobacco products such as cigarettes, cigars and chewing tobacco containing a stable citrus flavor which contributes to improved flavor and aroma of the smoking or chewing article, in the package as well as during the consumption of the product.

It is well known that a citrus nuance is a very desirable aroma and taste in a tobacco product. Many attempts have been made in the past to amplify this citrus nuance to a level that can be easily perceived as a citrus flavor in the product. However, these attempts have failed because prior citrus flavorants are either unstable after being applied to the tobacco blend, yield negative taste characteristics when applied at a level high enough for citrus flavor to be perceived by the smoker or do not retain perceivable citrus notes throughout storage and the full smoking time of the smoking article.

U.S. Pat. No. 4,627,449 discloses the use of a mixture of the specific saturated aldehydes n-hexanal, n-octanal, n-nonanal and n-heptanal, dissolved in ethanol and applied to smoking articles, i.e. filter tip material and tobacco, to give a "citrusy effect" to smoking articles.

U.S. Pat. No. 3,988,487 discloses the use of certain aldehydes in the form 2-alkylidene-3-alkenal reacted with alcohol to give a di-lower alkyl acetal to impart a fresh green flavor to tobacco. These diacetals, either alone or in combination with one or more adjuvants such as n-decanal, n-octanal, n-nonanal, n-decanal or citral, have been used to enhance the organoleptic properties of foodstuffs including tobacco.

According to Bedoukian in *Perfumery and Flavoring Synthetics,* Third Edit., pp. 106–118, citral per se is of limited value in fragrance formulations and as a flavoring, even though it has a powerful lemon aroma. It is recognized that citral is a rather active and unstable terpenoid which may cause problems as a fragrance or flavorant in various products. Citral dimethyl acetal and citral diethyl acetal have been used as fragrance materials in products where citral is unstable, but the acetals have been found to lack the true lemon odor and strngth of citral.

This invention seeks to improve on prior citrus-flavored tobacco products by providing tobacco articles having a stable ture and strong citrus flavor which is sustained through both shelf and package storage and the smoking or chewing of the article.

SUMMARY OF THE INVENTION

It has now been found that if citral acetal is applied to tobacco articles, the resulting smoking articles have a protracted true and strong citrus aroma and flavor through a shelf life of six to eight months and at the end of that time still have a pleasing and improved citrus character both in the package and throughout the smoking of the article.

Citral acetals are formed by reacting 3,7-dimethyl-2,6-octadienal (citral) with an excess of an alcohol (ROH) in the presence of acid to form the acetal.

Citral

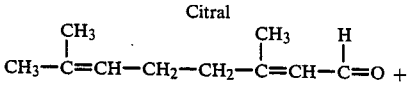

-continued

Citral hemiacetal

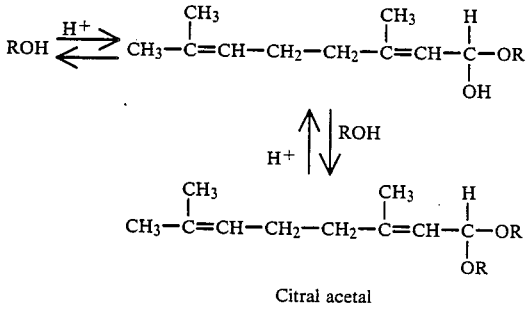

Citral acetal

Citral acetal compounds of use in this invention include, but are not limited to, citral dimethyl acetal, citral diethyl acetal, citral glycerol acetal and citral propylene glycol acetal and are herein referred to collectively as citral acetals. Based on experimentation, some citral acetal compounds yielded truer citrus character on smoking than others, and citral dimethyl acetal is a preferred compound.

The citral acetal can be incorporated into the smoking article by applying the citral acetal to the filter, the tobacco blend, the cigarette paper, the tipping paper of the article or seam adhesive, or any combination of these applications. Applying citral acetals to smoking articles in this manner results ina pleasing character to the smoker which lasts for the full time of the tobacco smoking article without the negative taste characteristic associated with prior citrus-flavored smoking articles and provides a citrus aroma smoking article with a longer shelf-life than prior citrus-flavored smoking articles.

In addition to incorporated in a smoking article itself, the citral acetal can be applied directly to the tobacco or tobacco blend. The term "tobacco" or "tobacco blend" used herein is understood to mean natural products such as, for example, burley, Turkish tobacco, Maryland tobacco, flue-cured tobacco and the like, including tobacco-like or tobacco-based products such as reconstituted or homogenized leaf and the like, as well as tobacco substitutes intended to replace natural tobacco, such as lettuce and cabbage leaves and the like. The tobaccos and tobacco products include those designed or used for smoking such as in cigarette, cigar, and pipe tobacco, as well as smokeless tobacco products such as snuff, chewing tobacco, and the like.

DETAILED DESCRIPTION OF THE INVENTION

It has been found that the use of citral acetals in tobacco blends or on filters is an unexpected improvement over the use of citral alone because of the stability of the true and strong citrus flavor imparted by citral acetal. The citrus flavored can be characterized as a fresh lemon peel-like flavor in tobacco products stored for short periods of time to a more intense lemon flavor in products that have been stored for relatively longer periods of time.

It is believed that the presence of trace amounts of residual acetic acid in the cellulosic material, either in the tobacco per se or the filter, catalyzes a slow exchange reaction between the citral acetal and the cellulosic material. The reaction is believed to result in the formation of citral hemiacetal, or mixed acetal, which attached to free hydroxyl residues present in the cellulose acetate filter or in the natural tobacco cellulose, and thereupon stabilizes the citral acetal in the filter or in the tobacco cellulose matrix . Upon smoking, the moist smoke hydrolyzes the loosely bound citral acetal to form a citral species in the smoke, thereby producing the desired citrus flavor at the time the article is smoked. Similarly, in a chewing tobacco product it is believed that the presence of saliva causes hydrolysis of the citral acetal and the release of citral upon use of the product. It is believed that reactions between citral acetal and the cellulosic medium, be it the filter or tobacco itself, contribute to the highly significant stabilization effects when compared to the use of citral alone.

For incorporation into a smoking article, the citral acetal is applied to any one or more of the following: the filter, the tobacco blend, the cigarette or cigar paper, the tipping paper, or the seam adhesive. The citral acetal is preferably applied to the filter of the smoking article. For application to the filter, the citral acetal is dissolved in a suitable solvent or filter plasticizer, for example, glyceryl triacetate, propylene glycol, or triethylene glycol diacetate. Triethylene glycol diacetate is the preferred plasticizer for commercial production of flavored filters. For use in cigarette filters, the citral acetal solution is applied to the filter in an amount to provide between approximately 0.1 mg and 10.0 mg citral acetal per cigarette filter, which is sufficient to impart a citrus flavor to the cigarette when smoked. For use in cigar filters, an amount of citral acetal which provides between about 1 to 25 mg citral acetal per filter is used to impart a citrus flavor to the cigar.

The amount of citral acetal used in the filter or on the tobacco blend is primarily dependent on the amount of citrus perception desired in the final product. For example, if only a citrus nuance is desired, then an amount less than about 4 mg citral acetal per cigarette would be used. If the objective is a cigarette or other smoking article with a predominant citrus character, about 4 mg citral acetal or more per cigarette would be used.

The amount of citral acetal added to the product is proportionate to the amount of the end citrus flavor perceived by the smoker. The preferred citrus flavor level will ultimately be based on consumer acceptance and there is no intention to limit the invention to any specific amount of citral acetal either in the filter, smoking tobacco product, or chewing tobacco product.

The invention will be better understood by reference to the following specific examples. These examples are provided for illustration purposes and are not meant to limit the scope of the invention.

For Examples 1–5 provided below, organoleptic evaluations iof various citrus-flavored tobacco articles were conducted by an Expert Smoking Panel consisting of experienced industry professionals. Evaluation of tobacco products by such panels of experts is well-known in the industry. After the prepared products had aged for periods of two days, one week and two weeks, the products were evaluated by the Expert Smoking Panel for acceptability and citrus character, i.e. a fresh, clean, true and strong lemony taste, on a scale of one to ten with one being low in citrus character or acceptability and ten being high in citrus character or acceptability. The results of these studies are set forth in the following examples.

EXAMPLE 1

Comparison of Applications of Citral or Citral Acetals to Cigarette Filter

Six mg of each of the following compounds, citral, citral propylene glycol acetal, citral diethyl acetal, citral dimethyl acetal, and citral glycerol acetal dissolved in propylene glycol were injected into the center of the filter portion of a 100 mm filter cigarette. Each cigarette filter was injected with only one of the compounds. The cigarettes were then placed into plastic vials and allowed to age for 2 days, 1 week and 2 weeks. After aging, the cigarettes were provided to the Expert Smoking Panel for evaluation.

The results of this panel study are presented in Table I.

TABLE I

| Compound | Amount Applied | Age | Acceptability | Citrus Character |
|---|---|---|---|---|
| Citral | 6 mg | 2 days | 3 | 7 |
| | | 1 week | 2 | 5 |
| | | 2 weeks | 2 | 4 |
| Citral propylene glycol acetal | 6 mg | 2 days | 4 | 7 |
| | | 1 week | 3 | 6 |
| | | 2 weeks | 2 | 4 |
| Citral diethyl acetal | 6 mg | 2 days | 2 | 4 |
| | | 1 week | 1 | 1 |
| | | 2 weeks | 1 | 1 |
| Citral dimethyl acetal | 6 mg | 2 days | 7 | 7 |
| | | 1 week | 7 | 8 |
| | | 2 weeks | 8 | 9 |
| Citral glycerol acetal | 6 mg | 2 days | 3 | 3 |
| | | 1 week | 2 | 1 |
| | | 2 weeks | 1 | 1 |

EXAMPLE 2

Comparison of Applications of Citral and Citral Acetals to Tobacco Blends

A 1% solution of each of the following compounds was made by adding 1 g of each compound to 100 ml 95% specially denatured alcohol: citral, citral propylene glycol acetal and citral dimethyl acetal. The solution were then injected at levels of 10 ppm and 25 ppm into the tobacco portion of cigarettes. Only one compound was applied to each cigarette. The cigarettes were then placed in the plastic vials, sealed and allowed to age. After aging for 2 days, 1 week and 2 weeks, the cigarettes were evaluated by the Expert Smoking Panel. The results of this study are presented in Table II.

TABLE II

| Compound | Amount Applied | Age | Acceptability | Citrus Character |
|---|---|---|---|---|
| Citral | 10 ppm | 2 days | 3 | 3 |
| | | 1 week | 2 | 2 |
| | | 2 weeks | 1 | 2 |
| | 25 ppm | 2 days | 4 | 5 |
| | | 1 week | 2 | 3 |
| | | 2 weeks | 1 | 2 |
| Citral propylene glycol acetal | 10 ppm | 2 days | 4 | 4 |
| | | 1 week | 3 | 3 |
| | | 2 weeks | 2 | 2 |
| | 25 ppm | 2 days | 5 | 5 |
| | | 1 week | 5 | 4 |
| | | 2 weeks | 3 | 3 |
| Citral dimethyl acetal | 10 ppm | 2 days | 4 | 5 |
| | | 1 week | 3 | 4 |
| | | 2 weeks | 3 | 4 |
| | 25 ppm | 2 days | 5 | 7 |
| | | 1 week | 5 | 6 |

TABLE II-continued

| Compound | Amount Applied | Age | Acceptability | Citrus Character |
|---|---|---|---|---|
| | | 2 weeks | 5 | 6 |

EXAMPLE 3

Application of Citral Dimethyl Acetal to Cigar Filters

Citral dimethyl acetal dissolved in propylene glycol were injected into the filters of filtered cigars, both regular and menthol, at levels of 5 mg and 10 g per cigar. The cigars were aged as in Examples 1 and 2 and evaluated by the Expert Smoking Panel for acceptability and flavor at the indicated times. In some cases the cigars were aged for one (1) month prior to evaluation. The results of these studies are presented in Table III.

TABLE III

| Compound | Amount Applied | Age | Acceptability | Citrus Character |
|---|---|---|---|---|
| | | Regular Cigars | | |
| Citral dimethyl acetal | 5 mg | 2 days | 4 | 2 |
| | | 1 week | 4.5 | 3 |
| | | 2 weeks | —* | —* |
| | 10 mg | 2 days | 6 | 4.5 |
| | | 1 week | 7 | 6.5 |
| | | 2 weeks | 7.5 | 7.0 |
| | | 1 month | 7 | 6.5 |
| | | Menthol Cigars | | |
| Citral dimethyl acetal | 5 mg | 2 days | 5 | 3 |
| | | 1 week | 5.5 | 4 |
| | | 2 weeks | —* | —* |
| | 10 mg | 2 days | 6.5 | 5 |
| | | 1 week | 7.5 | 7 |
| | | 2 weeks | 8 | 7.5 |
| | | 1 month | 7.5 | 7 |

*Flavor level too low for valid evaluation

EXAMPLE 4

Application of Citral Dimethyl Acetal to Chewing Tobacco

Citral dimethyl acetal was top sprayed on loose leaf chewing tobacco at levels of 1.0 ml and 2.0 ml (10 ml and 20 ml of 10% solution in 95% specially denatured alcohol) per pound of chewing tobacco. The results of the evaluations by the Expert Panel following aging as in Examples 1 and 2 of the treated chewing tobacco are presented in Table IV. In some cases, the chewing tobacco samples were aged for one (1) month before evaluation.

TABLE IV

| Compound | Amount Applied | Age | Acceptability | Citrus Character |
|---|---|---|---|---|
| Citral dimethyl acetal | 2.0 ml | 2 days | 4 | 8.5 |
| | | 1 week | 5 | 9 |
| | | 2 weeks | 5 | 9 |
| | 1.0 ml | 2 days | 6 | 8 |
| | | 1 week | 7 | 9 |
| | | 2 weeks | 7.5 | 9 |
| | | 1 month | 7 | 8.5 |

EXAMPLE 5

Full-Scale Production of Filtered Cigarettes Containing Citral Dimethyl Acetal In the Filters After evaluation by the Expert Smoking Panel, a full scale production run was made using citral dimethyl acetal in the cigarette filter. A solution of citral dimethyl acetal was prepared by dissolving 286.00 grams citral dimethyl acetal in 802.75 grams triethylene glycol diacetate. The amount of the solution was sufficient for application to about 16,000 filter rods.

The solution was applied to the filter rods using standard cigarette filter manufacturing procedures. The citral dimethyl acetal/triethylene glycol diacetate solution was placed in a receptacle on the cigarette filter rod maker which allowed the solution to be sprayed onto a moving band of cellulose acetate filter tow passing through the filter maker at an amount that would result in a weight increase of about 11% per filter rod. The sprayed two material was then enfolded within a filter plug wrap and formed into filter rods using standard techniques. The filter rods containing about 20 mg citral dimethyl acetal were each divided into four cigarette filters which were then incorporated into cigarettes using standard manufacturing procedures and yield finished filter cigarettes containing about 5 mg citral dimethyl acetal per filter.

The resulting cigarettes were aged for a period of several months. Periodically, at the times indicated in Table V, samples of the cigarettes were evaluated by the Expert Smoking Panel as described above. The results of the organoleptic evaluation of the production cigarettes by the Expert Smoking panel are provided in Table V.

It was noticed by the Expert Panel that the citrus character of the products became enhanced with age, ranging from a lemon peel nuance in the shorter aged samples (six weeks) to a more pronounced lemon flavor as the products reached the maximum shelf life (6–8 months).

TABLE V

Expert Smoking Panel Results
Citral Dimethyl Acetal in Production Run Cigarette Filters

| Age | Acceptability | Citrus Character |
|---|---|---|
| 2 days | 7.0 | 7.0 |
| 2 weeks | 8.0 | 9.0 |
| 1 month | 9.0 | 9.0 |
| 3 months | 9.0 | 9.0 |
| 6 months | 8.5 | 8.5 |
| 8 months | 7.5 | 8.0 |

EXAMPLE 6

Evaluation of Citrus-flavored Cigarettes by Consumer Focus Groups

Test samples of the citrus-flavored cigarettes of Example 5 were also evaluated by a test group of consumers divided into focus group settings. A focus group consisted of eight to ten people who were given the test sample and then questioned by an experienced customer test moderator regarding their likes and dislikes of the product. A total of 95 consumers were interviewed. These consumers, who were interviewed in different geographical locations in the United States, were selected to represent the general smoking population with some weighting given to low "tar" smokers.

The citrus-flavored cigarettes produced as described in Example 5 were universally found by the focus groups to be unique and unlike anything that the consumers had smoked before. The cigarettes, which had been aged at least six weeks prior to smoking, were said to be lemony in taste, refreshing, mild and very satisfying. Most of the consumers in the focus groups found the products to be highly acceptable and further stated that they would purchase the product if it were made available.

The test moderator, an expert with over thirty years experience in performing such focus group testing, stated that no other cigarette product of any type had produced such a high interest level or had generated so much enthusiasm as the citrus-flavored cigarettes of Example 5.

We claim:

1. A process for producing stable citrus flavored tobacco articles which exhibit a true citrus taste when smoked or chewed comprising the steps of adding about 0.1 mg to 25 mg of citral acetal to the tobacco article and aging the tobacco article for at least about two weeks in a closed container.

2. A process according to claim 1 in which the citral acetal is selected from the group consisting of citral dimethyl acetal, citral diethyl acetal, citral glycerol acetal and citral propylene glycol acetal.

3. A process according to claim 1 in which the citral acetal is citral dimethyl acetal.

4. A process according to claim 1 wherein the citral acetal is present in the part of the tobacco article selected from at least one of the group consisting of the filter, the tobacco blend, the wrapping paper and the adhesive.

5. A process according to claim 1 in which the tobacco article is a filtered cigarette.

6. A process according to claim 5 in which the citral acetal is applied to the filter in an amount of about 0.1 mg to 10 mg citral acetal per tobacco article.

7. A process according to claim 1 in which the tobacco article is a filtered cigar.

8. A process according to claim 7 in which the citral acetal is applied to the filter in an amount of about 1 to 25 mg citral acetal per tobacco article.

9. A process according to claim 1 in which the tobacco article is chewing tobacco.

10. A process according to claim 9 in which the citral acetal is applied to the chewing tobacco in an amount of about 0.1 mg to 6 mg citral acetal per gram of chewing tobacco.

11. A stable citrus-flavored tobacco article prepared according to the process of claim 1.

12. A process for producing stable lemon-flavored tobacco articles which exhibit a true lemon taste when smoked comprising the steps of adding about 4 mg to 10 mg of citral acetal to the tobacco article and aging the tobacco article for at least about two weeks in a closed container.

13. A process according to claim 12 in which the citral acetal is citral dimethyl acetal.

14. A stable lemon-flavored tobacco article prepared according to the process of claim 12.

15. A stable lemon-flavored tobacco article prepared according to the process of claim 13.

* * * * *